US008011340B2

(12) United States Patent
Bicker et al.

(10) Patent No.: US 8,011,340 B2
(45) Date of Patent: Sep. 6, 2011

(54) OIL PAN

(75) Inventors: Wolf-Dietrich Bicker, Trebur-Astheim (DE); Peter Eichert, Kaiserslautern (DE)

(73) Assignee: GM Global Technology Operations LLC, Detroit, MI (US)

( * ) Notice: Subject to any disclaimer, the term of this patent is extended or adjusted under 35 U.S.C. 154(b) by 291 days.

(21) Appl. No.: 12/120,930

(22) Filed: May 15, 2008

(65) Prior Publication Data

US 2008/0283020 A1 Nov. 20, 2008

(30) Foreign Application Priority Data

May 18, 2007 (DE) ..... 10 2007 023 406

(51) Int. Cl.
*F02B 77/00* (2006.01)

(52) U.S. Cl. ..... 123/195 C; 184/106

(58) Field of Classification Search ..... 123/195 C, 123/196 R; 184/106
See application file for complete search history.

(56) References Cited

U.S. PATENT DOCUMENTS

| | | | | |
|---|---|---|---|---|
| 3,509,861 | A | 5/1970 | Deutschmann et al. | |
| 4,056,168 | A | 11/1977 | Bajohr | |
| 6,041,752 | A * | 3/2000 | Van Klompenburg | 123/195 C |
| 6,142,257 | A | 11/2000 | Bruener et al. | |
| 6,257,193 | B1 * | 7/2001 | Alpan et al. | 123/196 R |
| 6,808,575 | B2 * | 10/2004 | Mauelshagen et al. | 156/73.5 |
| 7,261,079 | B2 | 8/2007 | Gunji et al. | |
| 2004/0084250 | A1 | 5/2004 | Morii et al. | |
| 2007/0221447 | A1 | 9/2007 | Bicker et al. | |

FOREIGN PATENT DOCUMENTS

| | | | |
|---|---|---|---|
| DE | 1183750 | B | 12/1964 |
| DE | 2457508 | A1 | 6/1976 |
| DE | 2732474 | A1 | 2/1979 |
| DE | 10305184 | A1 | 3/2005 |
| DE | 102005061953 | A1 | 7/2006 |
| GB | 1595130 | A | 8/1981 |

* cited by examiner

*Primary Examiner* — Noah Kamen
(74) *Attorney, Agent, or Firm* — Ingrassia Fisher & Lorenz, P.C.

(57) ABSTRACT

An oil pan is provided for an internal combustion engine. The oil pan includes, but is not limited to a base part configured to form an oil sump and a suction channel that opens into the oil sump through an opening. The oil pan also includes, but is not limited to a nose in a region of the opening for at least partly covering a cross section of the suction channel in a horizontal direction of flow.

18 Claims, 1 Drawing Sheet

OIL PAN

CROSS-REFERENCE TO RELATED APPLICATION

This application claims priority to German Patent Application No. 102007023406.8, filed May 18, 2007, which is incorporated herein by reference in its entirety.

TECHNICAL FIELD

The invention generally relates to an oil pan for an internal combustion engine.

BACKGROUND

DE 10 2004 024 517 A1 discloses an oil pan for an internal combustion engine which comprises a base part for the oil sump and a suction pipe which opens into a suction region of the base part. The suction region has a cylindrical wall portion in which one or more suction windows are positioned and which is upwardly closed by a cover. In the suction region into which the suction pipe opens, an oil pump ensures negative pressure, as a result of which the oil located in the base part initially flows through the suction window into the suction region and then out of the suction region into the suction pipe. A disadvantage of this configuration is the complex construction of the suction region which, on the one hand, entails high production costs and on the other hand complicates assembly and maintenance.

Thus, at least one object of the present invention is to provide an oil pan for an internal combustion engine, which oil pan is characterised by a simplified construction and by low production costs. In addition, other objects, desirable features, and characteristics will become apparent from the subsequent summary, detailed description, and the appended claims, taken in conjunction with the accompanying drawings and this background.

SUMMARY

The at least one object is achieved with an oil pan for an internal combustion engine that includes, but is not limited to a base part to form an oil sump and a suction channel to draw up oil by suction. The suction channel opens into the oil sump through an opening. The suction channel has a nose for at least partly covering the suction channel cross section in a horizontal direction of flow.

An embodiment with a cap-shaped nose on the suction channel in the region of the opening produces a substantially uniform flow of the oil, to be drawn up by suction, from the oil sump into the suction channel by a simple construction of the suction channel, without having to position additional elements in the oil pan, with the nose preventing air from passing into the suction channel. The nose makes it possible for the oil to be able to flow into the suction channel, preferably only at the deepest oil level in the oil sump. In this respect, the nose extends over at least a partial region of the suction channel cross section in the direction of flow so that there is preferably formed between the base part and the nose a gap through which the oil is able to flow from the oil sump into the suction channel. The fact that the suction channel is upwardly closed by the nose in the opening region and only a narrow gap is formed in the opening region of the suction channel means that a disadvantageous vortex effect of the inflowing oil is prevented. Perpendicularly to the direction of flow, the distance between the lower region of the nose and the part of the suction channel opposite the lower region of the nose preferably corresponds to the cross-sectional area of the suction channel. An oil pump produces negative pressure at the opening region of the suction pipe, as a result of which the oil located in the oil sump of the base part can flow through a gap formed by the base part and the nose into the opening of the suction channel. The oil which has been drawn up by suction flows through the suction channel and arrives in particular at the individual points of the engine to be lubricated, for example the crankshaft bearing, the big-end bearing, the tappets or the camshaft bearing.

A particular effect of the arrangement according to an embodiment of the invention of a nose to at least partly cover the suction channel cross section in a horizontal flow direction in the region of the opening into the suction channel is that air is not also drawn up by suction when the oil is being conveyed by virtue of the effective negative pressure in the opening region, which would adversely affect the engine lubrication. In particular during, for example, sharp cornering of the vehicle, when the oil level can fluctuate in the oil pan, the nose prevents the oil level in the opening region of the suction channel from falling to such an extent that air could pass into the suction channel.

Furthermore, the nose allows a simple structural configuration with merely low production costs of the oil pan. Moreover, the assembly effort is reduced. Compared to known oil pans, the oil pan according to an embodiment of the invention requires fewer parts, since for example an additional suction device is not required in the region of the oil sump. In particular, the arrangement of a nose at the opening of the suction channel means that an additional cover is no longer needed. Since fewer parts are now required, the remaining parts located in the oil pan, particularly in the region of the oil sump, can have greater tolerances.

Production can be carried out simply and quickly by, for example milling a lateral opening into a pipe closed with a cross-sectional area. For easier production, the nose is preferably conical.

The nose preferably extends geodetically downwards from above. Consequently, a gap is produced in the region of the opening between the base part and the nose through which the oil must pass before it is able to flow into the suction channel, with air being prevented from passing into the suction channel together with the oil.

According to a further embodiment, the nose is formed integrally with the suction channel. The integral connection between the suction channel and the nose allows a simple production and possible leakage between the transition region of the suction pipe and the nose is prevented.

Furthermore, it is preferably provided that the suction channel is at least partly integrally connected with the base part. In this respect, the suction channel is preferably integrally connected with the base part in the region opposite the nose. The integral embodiment provides a compact construction, at the same time allowing savings to be made in terms of weight and cost. Faulty assembly in respect of the suction channel, which could result in leakages occurring, are ruled out by the arrangement according to an embodiment of the invention.

According to a further embodiment, the base part at least partly forms the opening. In this respect, the region of the suction channel on which the nose is positioned projects over a part of the base part, so that the opening region on the side of the suction channel opposite the nose is at least partly formed by the base part.

Furthermore, the base part is planar in the region of the opening. Due to the planar configuration of the base part, the distance of the nose to the base part is preferably substantially uniform, so that the oil flow can be drawn up by suction uniformly into the suction channel, as a result of which the oil flow in turn is able to flow into the suction channel under a constant pressure over the cross-sectional surface of the suction channel. The uniform inflow avoids a disadvantageous vortex flow of the oil flow.

An embodiment of the invention also relates to an internal combustion engine comprising a crankshaft housing and an oil pan connected to the crankshaft housing, it being possible for the oil pan to be configured and developed as described above.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses. Furthermore, there is no intention to be bound by any theory presented in the preceding summary and background or the following detailed description.

Figure 1:
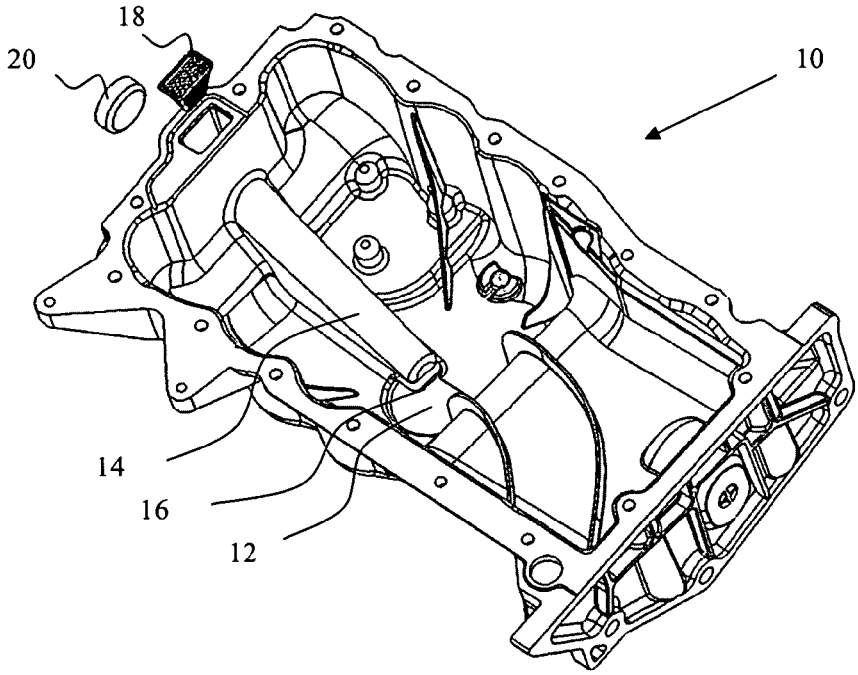
FIG. 1 is a schematic perspective view of an oil pan according to an embodiment of the invention.

The oil pan 10 shown in FIG. 1 for an internal combustion engine comprises a base part 12 to form an oil sump and a suction channel 14 to draw up oil by suction, the suction channel 14 opening into the oil sump through an opening 16. The oil provided for lubricating the engine is located in the oil sump of the base part 12 of the oil pan 10. In this arrangement, the oil sump is preferably configured perpendicularly to the bottom of the base part 12.

The suction channel 14 is preferably conical, the diameter of the suction channel 14 being smaller at the opening 16 than on the side opposite the opening 16, on which side a filter unit 18 is positioned. The filter unit 18 can preferably consist of a coarse filter which predominantly screens relatively large particles out of the oil flow which is to be conveyed. A further fine filtering operation can take place in a second filter (not shown here), the filter elements of which can preferably be formed of paper or of a fibrous material filling. A sealing element 20, such as a stopper is provided to seal the suction channel 14 on the side opposite the opening 16. The suction channel 14 is preferably in the form of a straight elongate tube, in which case advantageously no elements deflecting the flow are provided in the suction channel 14.

Figure 2:
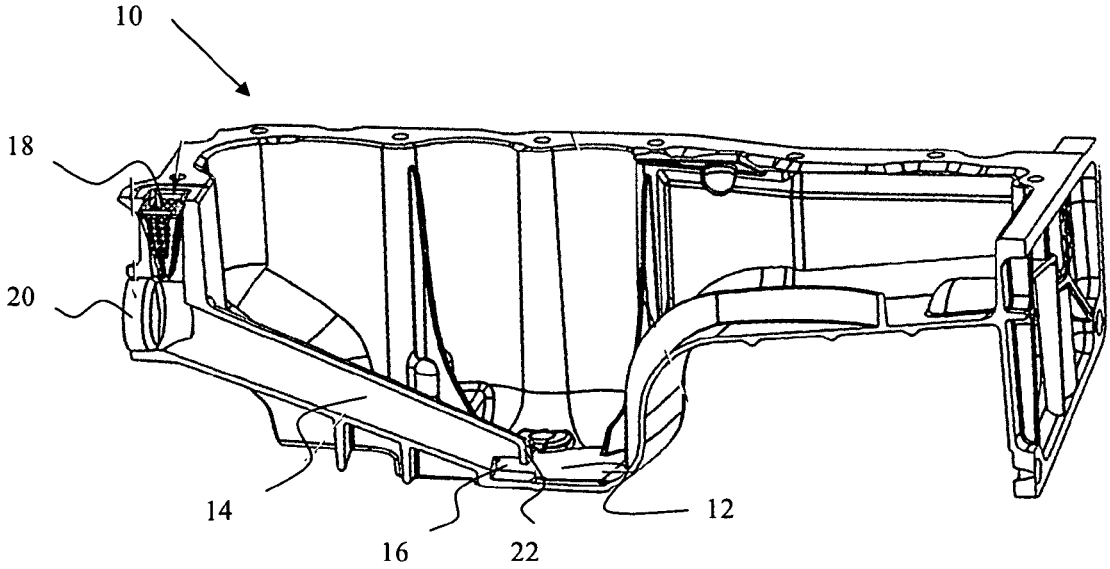
FIG. 2 is a schematic sectional view of an oil pan according to an embodiment of the invention.

As shown in FIG. 2, the suction channel 14 has, in the region of the opening 16, a nose 22 to a least partly cover the suction channel cross section in a horizontal direction of flow. The nose 22 extends over at least a part of the cross-sectional area of the suction channel 14, the nose 22 preferably being positioned on the side of the suction channel 14 opposite the base part 12. Formed between the base part 12 and the nose 22 is a gap through which the oil can flow into the suction channel 14 in the direction of flow from the oil sump. In the region of the opening 16, the suction channel 14 is preferably longer in the location where the nose 22 is positioned than the region of the suction channel 14 which is opposite the nose 22 and which adjoins the base part 12, such that the part of the suction channel 14 with the nose is able to overlap a part of the base part 12. In so doing, the base part 12 can at least partly form the opening 16 and is preferably planar in the region of the opening 16. The nose 22 extends geodetically downwards from above in the direction of the base part 12, the nose 22 being substantially perpendicular to the base part 12. Formed between the base part 12 and the nose 22 is a gap through which a defined quantity of oil can flow from the oil sump in the direction of the suction channel 14, and in a simple manner the nose 22 prevents air from being able to flow together with the oil into the suction channel 14.

While at least one exemplary embodiment has been presented in the foregoing detailed description, it should be appreciated that a vast number of variations exist. It should also be appreciated that the exemplary embodiment or exemplary embodiments are only examples, and are not intended to limit scope, applicability, or configuration in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. An oil pan for an internal combustion engine, comprising:

a base part configured to form an oil sump and a suction channel that opens into the oil sump through an opening; and a nose in a region of the opening for at least partly covering a cross section of the suction channel in a horizontal direction of flow, the nose extending geodetically downwards, wherein the suction channel is slanted downward to the nose.

2. The oil pan according to claim 1, wherein the nose is substantially perpendicular to the base part.

3. The oil pan according to claims 1, wherein the nose is integrally connected with the suction channel.

4. The oil pan according to claim 1, wherein the suction channel is at least partly integrally connected with the base part.

5. The oil pan according to claim 1, wherein the base part at least partly forms the opening.

6. The oil pan according to claim 5, wherein the base part is planar in the region of the opening.

7. An internal combustion engine, comprising:

a crankshaft housing; and an oil pan that is coupled to the crankshaft housing, the oil pan comprising:

a base part configured to form an oil sump and a suction channel that opens into the oil sump through an opening; and a nose in a region of the opening for at least partly covering a cross section of the suction channel in a horizontal direction of flow, the nose extending geodetically downwards, wherein the suction channel is slanted downward to the nose.

8. The internal combustion engine according to claim 7, wherein the nose is substantially perpendicular to the base part.

9. The internal combustion engine according to claim 7, wherein the nose is integrally connected with the suction channel.

10. The internal combustion engine according to claim 7, wherein the suction channel is at least partly integrally connected with the base part.

11. The internal combustion engine according to claim 7, wherein the base part at least partly forms the opening.

12. The internal combustion engine according to claim 11, wherein the base part is planar in the region of the opening.

13. An oil pan for an internal combustion engine, comprising:

a base part configured to form an oil sump and a suction channel that opens into the oil sump through an opening; and a nose in a region of the opening for at least partly covering a cross section of the suction channel in a horizontal direction of flow, the nose being substantially perpendicular to the base part, wherein the suction channel is slanted downward to the nose.

14. The oil pan according to claim 13, wherein the nose the nose extends geodetically downwards.

15. The oil pan according to claim 13, wherein the nose is integrally connected with the suction channel.

16. The oil pan according to claim 13, wherein the suction channel is at least partly integrally connected with the base part.

17. The oil pan according to claim 13, wherein the base part at least partly forms the opening.

18. The oil pan according to claim 17, wherein the base part is planar in the region of the opening.

* * * * *

UNITED STATES PATENT AND TRADEMARK OFFICE

CERTIFICATE OF CORRECTION

PATENT NO. : 8,011,340 B2
APPLICATION NO. : 12/120930
DATED : September 6, 2011
INVENTOR(S) : Wolf-Dietrich Bicker et al.

It is certified that error appears in the above-identified patent and that said Letters Patent is hereby corrected as shown below:

Column 6, Lines 1 and 2 “wherein the nose the nose extends” should be --wherein the nose extends--

Signed and Sealed this
Twenty-sixth Day of June, 2012

David J. Kappos

David J. Kappos
*Director of the United States Patent and Trademark Office*